US007404468B2

(12) United States Patent
Kuo

(10) Patent No.: US 7,404,468 B2
(45) Date of Patent: Jul. 29, 2008

(54) ELEVATOR HAVING SECOND DRIVING DEVICE

(75) Inventor: Chang Hsin Kuo, Taichung (TW)

(73) Assignee: Hiwin Technologies Corp., Situn Taichung (TW)

( * ) Notice: Subject to any disclaimer, the term of this patent is extended or adjusted under 35 U.S.C. 154(b) by 106 days.

(21) Appl. No.: 11/494,008

(22) Filed: Jul. 27, 2006

(65) Prior Publication Data

US 2008/0023272 A1 Jan. 31, 2008

(51) Int. Cl.
*B66B 9/02* (2006.01)

(52) U.S. Cl. ..... 187/268; 187/267; 74/89.26; 74/89.29; 74/89.23

(58) Field of Classification Search ..... 187/267–268; 74/89.26, 89.31, 89.33, 89.23, 89.39; *F16G 57/10*
See application file for complete search history.

(56) References Cited

U.S. PATENT DOCUMENTS 3,381,541 A 5/1968 Thireau et al.
3,815,710 A 6/1974 Shrum ..... 87/29 R
3,881,575 A * 5/1975 Manaugh ..... 187/268
4,635,491 A * 1/1987 Yamano et al. ..... 74/89.41
4,742,891 A * 5/1988 Kunii et al. ..... 187/267
4,747,320 A * 5/1988 Nilsson ..... 74/411.5
5,339,704 A * 8/1994 Lindberg ..... 74/89.39

* cited by examiner

*Primary Examiner*—Peter M. Cuomo
*Assistant Examiner*—Stefan Kruer
(74) *Attorney, Agent, or Firm*—Charles E. Baxley

(57) ABSTRACT

An elevator includes an elevator car guided to move up and down relative to a supporting member, a screw shaft having an upper end attached to the supporting member, a driving nut rotatably supported in a coupling device and threaded with the screw shaft, one driving device coupled to rotate the screw shaft and to move the driving nut up and down along the screw shaft, and a coupling device rotatably attached onto the driving nut and coupled to the elevator car. Another spare driving device may further be coupled to drive the screw shaft for moving the elevator car to a lower level or a safe location when the driving device either fails or is damaged.

11 Claims, 2 Drawing Sheets

ELEVATOR HAVING SECOND DRIVING DEVICE

BACKGROUND OF THE INVENTION

1. Field of the Invention

The present invention relates to a screw shaft for such as an elevator, and more particularly to a screw type elevator having a second or auxiliary driving device for moving a screw shaft and/or a carriage and for allowing the carriage to be moved to a safe location when the main or primary driving device or power has become failure.

2. Description of the Prior Art

Typical elevator systems comprise a carriage for moving a payload such as personnel or cargo traversely along a vertically elongated structural environment, and a finite length framework along which the vertically movable carriage through a guidable yoke slidably traverses, and one or more upright rails for guiding the carriage to move up and down relative to the elongated structural environment.

For example, U.S. Pat. No. 3,381,541 to Thireau et. al. discloses one of the typical elevator systems or transmission devices comprising a carriage guided to move up and down along one or more upright rails, and a flexible band employed with the use of friction arising out of the contact of the band and a supporting or backing support.

U.S. Pat. No. 3,815,710 to Shrum discloses another typical elevator system comprising a sensing circuitry to protect an elevator car from striking a dislodged counterweight or other structure, and the elevator car is to be moved relative to a structure having a number of floors or landings and for being guided to move up and down in a vertical path with wire ropes.

In both the typical elevator systems, only one motor driving means or device is provided and coupled to the carriage or the elevator car via the wire ropes for pulling and moving the carriage or the elevator car up and down relative to the elongated structural environment.

However, when the electric power supply is cut off, particularly when earthquakes are occurred, or when the single motor driving means or device is damaged or become failure, the carriage or the elevator car may no longer be moved up and down relative to the elongated structural environment, and may only be energized or moved again when the electric power supply is recovered.

The present invention has arisen to mitigate and/or obviate the afore-described disadvantages of the conventional driving mechanisms for elevator systems.

SUMMARY OF THE INVENTION

The primary objective of the present invention is to provide a screw type elevator having a second or auxiliary driving device for moving a screw shaft and/or a carriage and for allowing the carriage to be moved to a safe location when the main or primary driving driving device has become failure.

In accordance with one aspect of the invention, there is provided an elevator comprising a supporting member, an elevator car to be guided to move up and down relative to the supporting member, a screw shaft attached to the supporting member, a first driving device coupled to the screw shaft for rotating the screw shaft, a driving nut threaded with the screw shaft and movable up and down along the screw shaft when the driving nut is rotated relative to the screw shaft, a coupling device supporting the driving nut and coupled to the elevator car for moving up and down along the screw shaft together with the driving nut, and a second driving device coupled to the driving nut for rotating the driving nut relative to the screw shaft when the first driving device can not action, and the elevator car be moved down to a safe location when either the first driving device or the second driving device has become failure or has damaged or when the electric driving power supply has become failure.

The second driving device includes a motor attached to the coupling device and coupled to the driving nut for rotating the driving nut relative to the screw shaft and for moving the elevator car to the safe location.

The motor of the second driving device includes a spindle, and a pinion attached to the spindle, and a gear attached to the driving nut and engaged with the pinion for allowing the gear to be rotated or driven by the motor.

The gear is attached to an outer peripheral portion of the driving nut. The motor may be a battery powered motor or other selected motors and may be energized or driven with a less electric power source.

One or more bearings may be disposed between the driving nut and the coupling device for allowing the driving nut to be smoothly driven or rotated relative to the coupling device.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
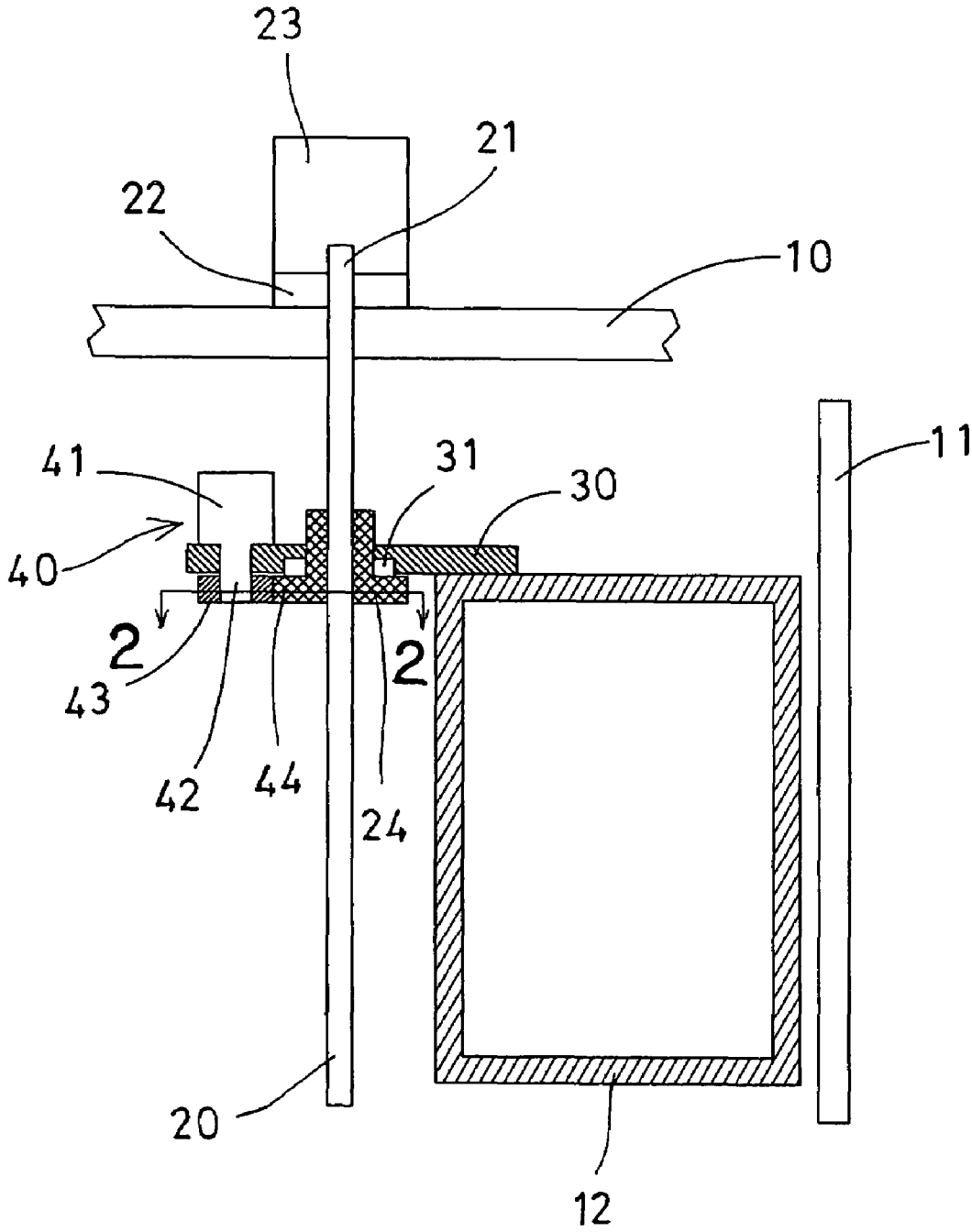
FIG. 1 is a partial cross sectional view of an elevator in accordance with the present invention.
Figure 2:
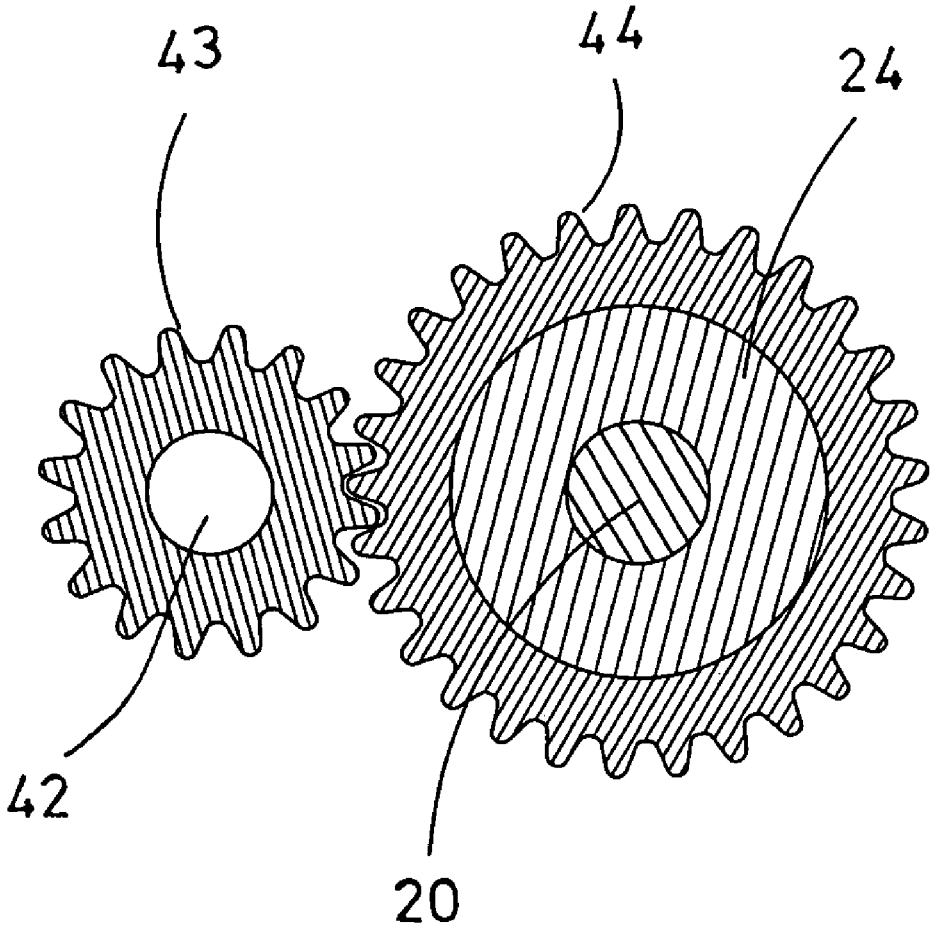
FIG. 2 is an enlarged partial cross sectional view of the elevator, taken along lines 2-2 of FIG. 1.

Referring to the drawings, and initially to FIG. 1, an elevator in accordance with the present invention comprises a ceiling or supporting member 10, one or more guide rails 11 vertically disposed for forming or defining a vertically elongated structural environment, and a carriage or elevator car 12 to be guided to move up and down relative to the supporting member 10 and along the guide rails 11 for moving a payload such as personnel or cargo up and down along the vertically elongated structural environment formed or defined by the vertically disposed guide rails 11. One or more typical wire ropes (not shown) may be selectively or additionally provided and coupled to the carriage or elevator car 12 for safely pulling and suspending the elevator car 12 at selected position.

A screw shaft or threaded member 20 includes an upper portion 21 vertically and rotatably attached to the supporting member 10 with such as a bearing or supporting device 22, and coupled to a first power or driving means or device 23, such as any selected motor 23 for allowing the screw shaft 20 to be rotated or driven by the first driving device 23. A driving nut or threaded member 24 is engaged or threaded with the screw shaft 20 for allowing the driving nut 24 to be moved up and down along the screw shaft 20 when the screw shaft 20 is rotated relative to the driving nut 24 by the first driving device 23. Normally, a weight (not shown) will be provided and coupled to the typical wire ropes for balancing purposes and for reducing the burden or the load applied to the screw shaft 20.

A coupling device 30 is rotatably attached or engaged onto the driving nut 24. The coupling device 30 may be rotatably secured to the driving nut 24 with one or more bearings 31, or relatively, one or more bearings 31 are disposed between the driving nut 24 and the coupling device 30, or the driving nut 24 is rotatably secured to the coupling device 30 with one or more bearings 31 for allowing the driving nut 24 to be smoothly rotated relative to the coupling device 30. The coupling device 30 is preferably attached or secured or coupled to the elevator car 12 with a soft or flexible or cushioning member (not shown) for resiliently coupling the coupling device 30 to the elevator car 12 and for preventing the coupling device 30 from being rotated or moved relative to the elevator car 12, but allowing the coupling device 30 to be moved up and down together with the elevator car 12, such that the coupling device 30 and the elevator car 12 may be moved up and down along the vertically disposed guide rails 11 by the threading engagement between the screw shaft 20 and the driving nut 24. The above-described structure is typical and will not be described in further details.

The elevator in accordance with the present invention is further to provide a second power or driving means or device 40 for moving the screw shaft 20 and/or the carriage or the elevator car 12 to a safe location when the electric driving power source has become failure. The second driving device 40 includes another power driving means or member 41, such as stepped motor, reduction gearing motor, or any other selected motor 41 disposed or attached or secured onto the coupling device 30 and includes a spindle 42 attached thereto or extended therefrom, and preferably extended out through the coupling device 30 and includes a pinion 43 attached or secured or coupled to the spindle 42 for allowing the pinion 43 to be rotated or driven by the power driving member 41 of the second driving device 40.

The second driving device 40 further includes a gear 44 attached or secured or coupled to the outer peripheral portion of the driving nut 24 and engaged or meshed with the pinion 43 for allowing the gear 44 to be rotated or driven by the driving member 41 of the second driving device 40 via the pinion 43, and thus for allowing the driving nut 24 to be selectively rotated or driven by the power driving member 41 of the second driving device 40 in order to move the coupling device 30 and the elevator car 12 along the guide rails 11, particularly to move the carriage or elevator car 12 down along the guide rails 11 to any safe location when the electric driving power source has become failure.

It is to be noted that the first driving device 23 is required to be powered or energized by a great electric power more than one (1) horse power to move or to actuate the carriage or elevator car 12 up and down relative to the supporting member 10 and along the guide rails 11, particularly to move the carriage or elevator car 12 up along the guide rails 11 to overcome the gravity force. When the electric driving power source has become failure, another great electric power electric source which is complicated and expensive is required to be provided to energize and to actuate the first driving device 23.

However, the second driving device 40 is designed to move the carriage or elevator car 12 down along the guide rails 11 that is not required to overcome the gravity force, such that the coupling device 30 and the elevator car 12 may be moved down along the guide rails 11 to any safe location when the electric driving power source has damaged or become failure or when earthquakes are occurred, and such that the second driving device 40 is not required to be powered or energized by a great electric power, and such that the second driving device 40 may be selected from battery or low powered second driving device 40 that may be operated with a less electric power more, such as lower than 200 watts, even when the electric driving power source has damaged or become failure.

In operation, the elevator car 12 may normally be moved up and down along the guide rails 11 by the first driving device 23. When the electric driving power source has damaged or become failure or when earthquakes are occurred, the second driving device 40 may be selectively powered or energized to move the coupling device 30 and the elevator car 12 down along the guide rails 11 to a lower level or to any safe location for allowing the elevator car 12 to be quickly opened and for allowing the users to get off the elevator car 12 as soon as possible.

It is further to be noted that the first driving device 23 may be the main or primary driving device for driving or rotating the screw shaft 20 relative to the driving nut 24, and the second driving device 40 may be the auxiliary driving device having a driving power smaller than that of the first driving device 23 for driving or rotating the driving nut 24 relative to the screw shaft 20. Alternatively, the second driving device 40 may also be the main or primary driving device for driving or rotating the driving nut 24 relative to the screw shaft 20, and the first driving device 23 may also be the auxiliary driving device having a driving power smaller than that of the second driving device 40 for driving or rotating the screw shaft 20 relative to the driving nut 24. The main or primary driving device operates in normal condition, but the auxiliary driving device acts when the main or primary driving device can not action.

Accordingly, the screw type elevator in accordance with the present invention includes a second driving device for moving the screw shaft and/or a carriage and for allowing the carriage to be moved to a safe location when the first driving device has become failure or has damaged, or when the electric driving power source has become failure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An elevator comprising:

a supporting member, an elevator car to be guided to move up and down relative to said supporting member, a screw shaft attached to said supporting member, a first driving device coupled to said screw shaft for rotating said screw shaft, a driving nut threaded with said screw shaft and movable up and down along said screw shaft when said driving nut is rotated relative to said screw shaft, a coupling device attached onto the driving nut and coupled to the elevator car for moving up and down along said screw shaft together with said driving nut, and a second driving device coupled to said driving nut for rotating said driving nut relative to screw shaft, wherein said elevator car may be moved down to a safe location when said first driving device has failed, and said second driving device is an auxiliary driving device for moving said elevator car to the safe location and includes a driving power smaller than that of said first driving device.

2. The elevator as claimed in claim 1, wherein said second driving device includes a motor attached to said coupling device.

3. The elevator as claimed in claim 1, wherein at least one bearing is disposed between said driving nut and said coupling device for allowing said driving nut to be smoothly rotated relative to said coupling device.

4. The elevator as claimed in claim 1, wherein said second driving device is an auxiliary driving device for moving said elevator car to the safe location, and includes a driving power smaller than that of said first driving device.

5. The elevator as claimed in claim 1, wherein said driving power of said auxiliary driving device is lower than 200 watts.

6. The elevator as claimed in claim 1, wherein said screw shaft is a ball screw shaft.

7. The elevator as claimed in claim 2, wherein said motor includes a spindle, and a pinion attached to said spindle, and a gear attached to said driving nut and engaged with said pinion for allowing said gear to be rotated or driven by said motor.

8. The elevator as claimed in claim 2, wherein said motor is a battery powered motor.

9. The elevator as claimed in claim 2, wherein said motor is a reduction gearing motor.

10. The elevator as claimed in claim 7, wherein said gear is attached to an outer peripheral portion of said driving nut.

11. The elevator as claimed in claim 4, wherein said driving power of said auxiliary driving device is lower than 200 watts.

* * * * *